United States Patent [19]

Peterson et al.

[11] Patent Number: 4,729,415

[45] Date of Patent: Mar. 8, 1988

[54] APPARATUS FOR DEBARKING TREES

[75] Inventors: Arnold N. Peterson, Eugene; Larry A. Sprague, Dexter, both of Oreg.

[73] Assignee: Peterson Pacific Corporation, Pleasant Hill, Oreg.

[21] Appl. No.: 72,774

[22] Filed: Jul. 13, 1987

[51] Int. Cl.[4] ..... B27L 1/00

[52] U.S. Cl. ..... 144/208 J; 83/149; 144/341; 144/343; 144/2 Z; 414/517

[58] Field of Search ..... 144/208 R, 208 B, 208 J, 144/2 Z, 341, 343; 414/502, 517; 83/160, 149

[56] References Cited

U.S. PATENT DOCUMENTS

| | | | |
|---|---|---|---|
| 4,214,616 | 7/1980 | Brisson | 144/208 J |
| 4,316,695 | 2/1982 | Knight, Sr. | 414/517 |
| 4,369,823 | 1/1983 | Gustafsson | 144/208 B |
| 4,627,783 | 12/1986 | De Flippi | 414/517 |
| 4,640,325 | 2/1987 | Vaders | 144/208 J |
| 4,690,187 | 9/1987 | Schmidt | 144/208 J |

*Primary Examiner*—W. Donald Bray
*Attorney, Agent, or Firm*—Robert L. Harrington

[57] ABSTRACT

A debarking apparatus including a closed bottom formed into a channel. A plunger is slidable in the channel and pushes bark material along the channel and out an open end of the channel. The plunger has a top surface that closes the channel as it moves through the debarking station. The bark deposited on the surface is wiped off and into the channel upon withdrawal. Preferably a shearing blade provided on the leading upper edge of the plunger shears material that protrudes above the channel opening.

4 Claims, 4 Drawing Figures

FIG. 3
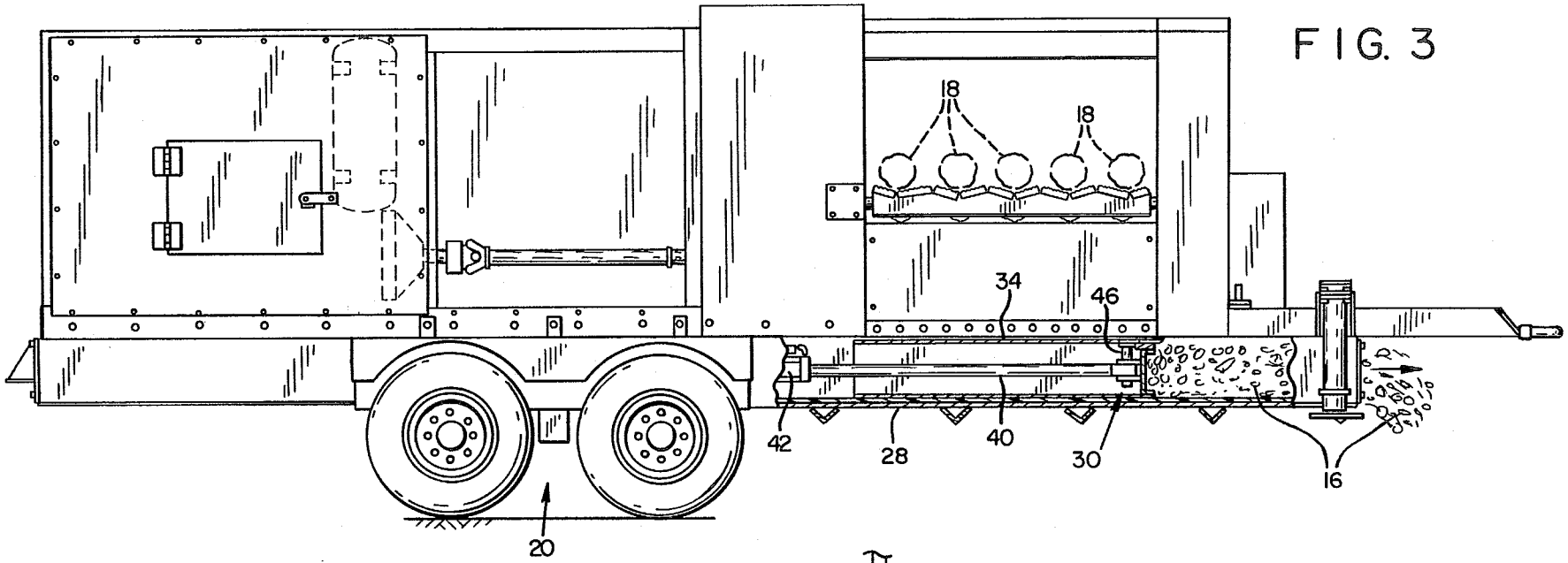
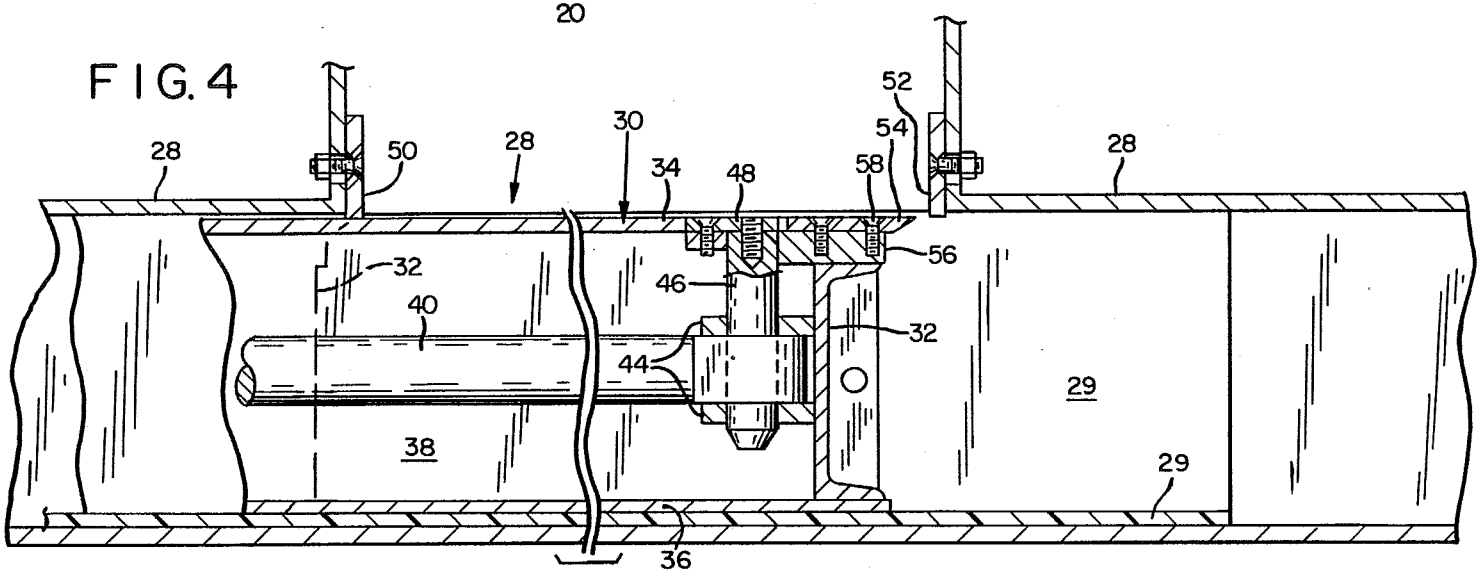
FIG. 4

APPARATUS FOR DEBARKING TREES

FIELD OF INVENTION

This invention relates to an apparatus for debarking tree stems or logs and more particularly to features for collecting and removing bark from the apparatus.

BACKGROUND OF THE INVENTION

A felled tree, referred to as a tree stem or log (these terms are used interchangeably) is preferably delimbed (removing the limbs of the tree) and debarked (removing the bark of the tree) before the tree stem is processed in a log mill. The operations of delimbing and debarking are generally performed separately. Delimbing is often done manually by a sawyer in an operation referred to as snitting. Debarking is accomplished by "beating" the outer surface of the log which breaks the bond between the bark and the wood core. The bark simply falls off the tree stem and accumulates underneath.

The operation of debarking a tree may be accomplished at the logging site or at the mill site. In the latter case, the debarking apparatus is a stationary unit. The apparatus is open under the debarking station and the bark falls onto a conveyor and is converged to a disposal site.

The debarking apparatus used at the logging site must be portable so it can be moved with the logging operation from site to site. This portability requirement generates problems for disposing of the bark. The apparatus when being moved must comply with road restrictions of height and width. There is not sufficient room under the log beaters of the debarking station to provide a conveyor system and still keep the log beaters and their associated mechanism below the maximum height requirements. Thus the portable debarking apparatus cannot simply be provided with an open bottom under the log beaters through which the bark can be dropped onto a conveyor. The invention herein is applicable to both stationary and portable debarking apparatus but as will be explained, has particular application for the portable debarking apparatus.

THE PRESENT INVENTION

Briefly, the preferred embodiment of the present invention has a closed bottom that defines a longitudinal channel crossway to the flow of tree stems through the apparatus. The channel extends to a remote position from the debarking station and is open-ended.

A plunger is worked back and forth in the channel. With the plunger in a fully withdrawn position, the channel is open under the debarking station and bark is dropped into the channel. The plunger then pushes the bark material through the channel and out the open end. During the forward pushing process, bark continues to fall and accumulates on the plunger. A wiper provided on the apparatus wipes the plunger surface during return movement of the plunger. The bark accumulated on the upper surface is thus wiped off the plunger surface and into the channel, to be removed by the plunger in the next cycle.

An important feature of the apparatus is a shear on the plunger and an anvil on the stationary structure (or vise versa) whereby bark material or occasional branches that protrude from the channel are simply severed as the plunger moves forward through the debarking station. The portion of such material that is in the channel is pushed out and the protruding portion is held back to be deposited in the channel (in the wiping operation) for the following cycle. These and other advantages and benefits will be more apparent by reference to the following detailed description and the drawings wherein:

FIG. 3 is a side view of the debarking apparatus as indicated by arrow 3—3 of FIG. 1; and FIG. 4 is an enlarged partial view of the plunger and channel as indicated by the encircled portion of FIG. 3.

Figure 1:
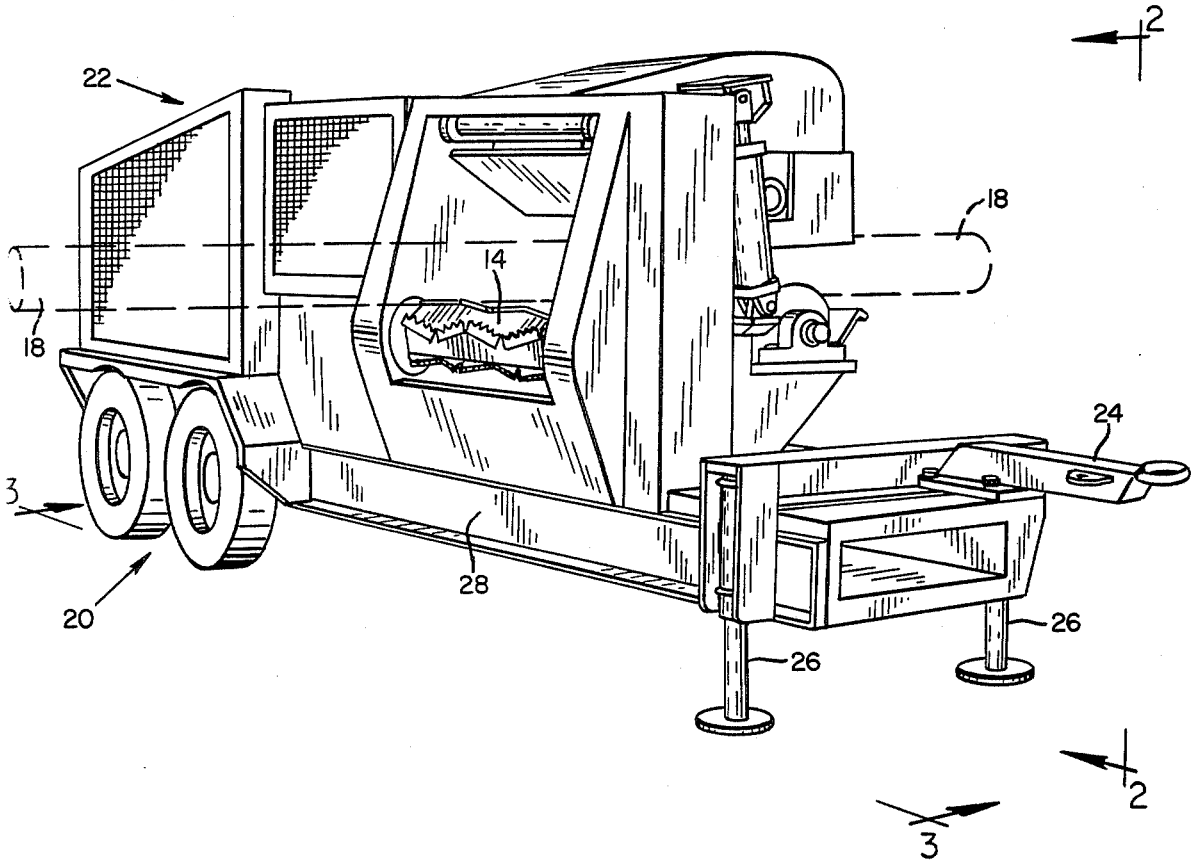
FIG. 1 is a perspective view of a portable debarking apparatus in accordance with the invention.
Figure 2:
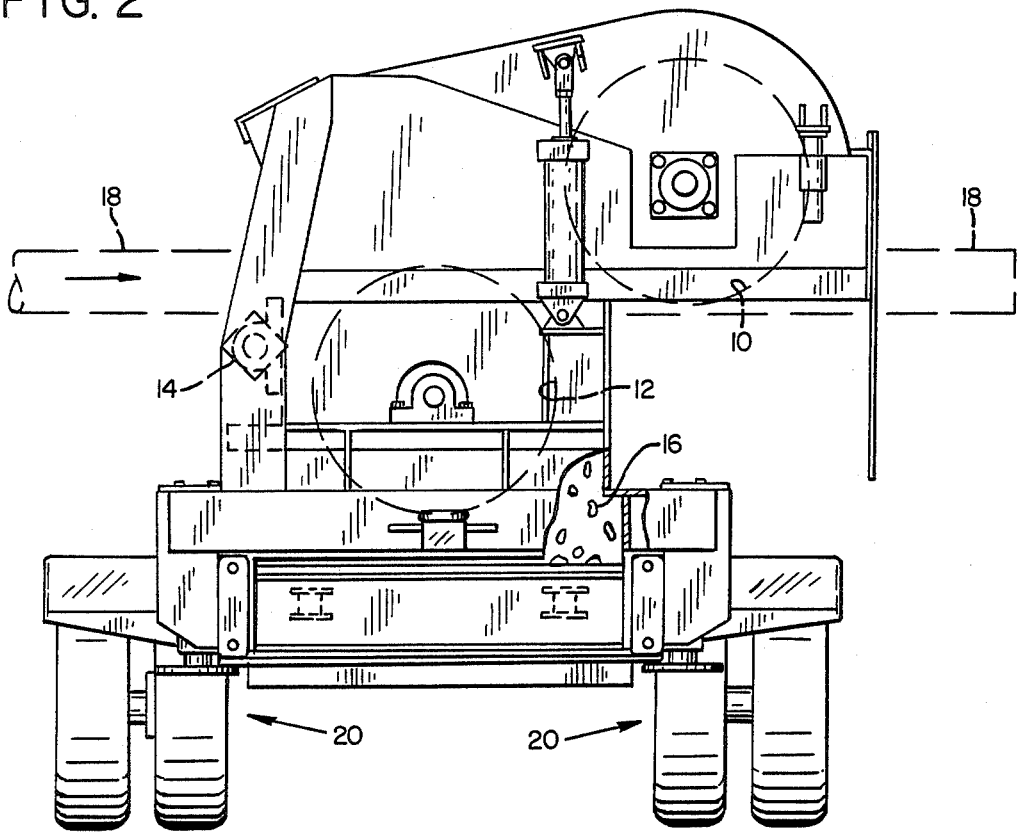
FIG. 2 is an end view of the debarking apparatus as indicated by arrow 2—2 in FIG. 1.

Referring first to FIGS. 1 and 2, illustrated is a debarking apparatus including upper and lower log beating/ bark removing flailing members 10 and 12. Although not illustrated in detail, the flailing members include rotating flails that repeatedly strike logs 18 being passed through the flails. The logs are fed through the flails, at least in part, by a driven feed roller 14. As described earlier, the flails break the bond between the bark and the wood core and the bark pieces and chunks 16 drop down beneath the flailing members (see FIG. 2 and FIG. 3, the latter illustrating the falling bark pieces 16 but not the flailing members).

For purposes of this invention, the manner of severing the bark from the core of the log or even of feeding the log through the flails is not material. It is sufficient to understand that the apparatus has that capability and that bark pieces are being accumulated in the apparatus below the flailing members. It will be noted however, that the combination of flailing members in a stacked arrangement as illustrated, creates a massive piece of equipment with inherent design problems for a portable unit. To provide a conveyor system beneath the lower flailing member is considered not feasible in a portable apparatus.

It will be apparent that the illustrated apparatus is intended for portability. A double axle, duel wheel arrangement generally indicated by arrow 20 supports the rear end of the apparatus (the rear end in this instance referring to the direction of movement of the apparatus as differentiated from the direction of flow of logs through the apparatus). Mounted over the duel wheel arrangement 20 are the motor, gas tanks and various accessories indicated in general by arrow 22 as again they are significant only in the context of illustrating the portability of the apparatus.

At the forward end of the apparatus is a tongue 24 designed to hook up to the hitch of a truck or tractor. Retractable supports 26 are lowered to the illustrated position of FIG. 1 while the apparatus is "parked" for debarking. It will be appreciated that when the tongue is hooked up to a tracktor or truck the supports 26 are retracted as shown in FIGS. 2 and 3.

The features of the invention will now be described. It is not feasible to simply allow the bark pieces 16 to fall to the ground and build up under the apparatus. The bark material quickly builds up to huge piles and in a very short time will cause problems. Attempting to continuously remove the bark from under the apparatus is not feasible.

In the present invention the apparatus is provided with a bottom section that is formed into a shallow receptacle for the bark materials. More precisely, the bottom section is formed into a channel 28 of uniform cross section including the area beneath the flailing members and extending front to back therefrom for a distance nearly equal to that of the debarking station. The channel is lined, on the bottom and sides with a plastic liner 29 to minimize friction and thus undesired wearing. The liner is a high molecular plastic cross-linked polymer having a side thickness of ⅜ inch and a bottom thickness of 1 inch. It is purchased on the market under the trademark S X L Cross-Linked Polymer. The front end of the channel, as indicated, terminates at a remote position at the front of the apparatus just short of the end of the tongue 24. The "front" end of the channel is open for ejection of bark material as will be explained.

Mounted in the channel 28 is a plunger 30 that includes a front plate 32, a top plate 34, a bottom plate 36 and side plates 38 (only one side plate is shown, e.g. in FIG. 4). The plates 32, 34, 36 and 38 are joined together to form an envelope that is open only at the back end. Protruded into the envelope through the back end is a pair of piston rods 40 that are driven forward and backward in the channel by hydraulic cylinders 42. The front end of the rods 40 are inserted between clevis ears 44 fixed to the back of front plate 32. Fastening is accomplished by a pin 46 having a head 48 that nests in the plate 34. Removal and insertion of the pin 46 can be accomplished from outside the plunger as will be apparent from reference to FIG. 4.

With the rods 40 fastened to the plunger 30, the plunger is reciprocated back and forth within the channel 28 with back and forth movement of the piston rod as dictated by activation of hydraulic pressure in cylinder 42. It is desirable to confine the reciprocal movement of the plunger and this is enhanced by a pair of guide strips fastened to the channel sides over the path of the plunger.

It will be appreciated from FIG. 3 that the rearward stroke of the plunger positions the front plate behind the debarking station as shown in dotted lines. The top of the channel 28 is open and with the plunger withdrawn, bark pieces 16 will fall into the channel. The forward stroke of the plunger pushes the bark pieces forward in the channel towards the open front end. The solid line position of the plunger shows the plunger in its forward position having pushed the bark material along the channel and through the open front end. It will be appreciated that the pile of bark pieces 16 is simply pushed out of the way with ease by repeated reciprocal motion of the plunger. From the position shown, the top plate 34 of the plunger closes the channel and bark material is deposited on the top plate 34. As the plunger is withdrawn, a wiper 50 positioned over the top plate 34 at the rear end of the flailing station, wipes the bark pieces off the plunger which then drop into the channel 28 and the process is repeated.

A problem that is encountered with this bark moving process is that bark pieces or even occasional branches will protrude upwardly from the confines of the channel in the debarking station. These protruding pieces, unless dislodged, will plug the channel and thus must be removed. Such is accomplished by the provision of an anvil piece 52 mounted over the plunger at the front end of the flailing station, and a cooperating blade 54 provided as the leading front edge of the plunger. The blade 54 is provided as a separate piece that is screwed into a block 56 with screws 58. The blade 54 is designed to fit to the front edge of the top plate 34 and forms an extension thereof as illustrated in FIG. 4. The anvil mounting is made slightly adjustable to enable adjustment of the anvil position relative to the blade 54 as wearing occurs.

IN OPERATION

As illustrated, logs are fed by feed roller 14 through the flailing station consisting of flailing members 10 and 12. The bark from the logs fall beneath the flailing members and into the shallow channel 28. The plunger is reciprocated on a periodic basis and when pushed forward by the piston rods 40, push the bark material that is in the channel toward the open front end of the channel. It will be appreciated that the forward movement of the plunger does not extend all the way to the end of the channel. Furthermore the lining is terminated just beyond the front end position of the plunger. It has been found that the expanded cross section created thereby beneficially allows some expansion of the bark material that has become compressed as it is forced through the channel. Plugging of the channel is less likely.

During the forward movement of the plunger, bark pieces or branches that protrude above the channel, are backed up to the anvil 52 and severed by the blade 58 provided on the front edge of the plunger. During the forward movement of the plunger, bark pieces that would otherwise fall into the channel fall onto the top plate 34 of the plunger. Return movement of the plunger opens the channel and the bark on the top plate is wiped from the top plate by wiper 50, and fall into the channel.

The process is then repeated. As the pile of bark materials builds to block the open end of the channel, there is little resistance and the oncoming bark from the channel simply pushes the material out of the way to spread the pile further and further out away from the apparatus.

Whereas others may conceive of improvements to the apparatus disclosed above as the preferred embodiment, the scope of the invention is intended to encompass such improvements as they may be included within the claim definitions that follow.

We claim:

1. A debarking apparatus comprising; a debarking station wherein bark removing apparatus removes bark from tree stems passed through the station, a channel member provided in the apparatus occupies a substantial portion of the area beneath the debarking station, said channel member extending in a direction crossway to the movement of logs through the station and extending a substantial distance in both directions beyond the debarking station, said channel member having an open top and closed sides and bottom in the area of the debarking station, and terminating at one end in a bark emitting opening that is remote from said debarking station;

a plunger slidably mounted in the channel member between a first position that is withdrawn from the area of the debarking station and at an end of the channel member opposite to the bark emitting opening, and a second position wherein the plunger resides in the debarking station, said plunger having a front face and upper surface that mates with the dimensions of the channel member, said upper surface closing the open top of the channel member when residing in said second position; and actuating means actuating movement of said plunger between said first and second positions to thereby open the channel member to bark pieces being removed from the tree stems while the plunger member is in the first position, with movement to the second position pushing the bark material residing within the channel member toward the bark emitting opening.

2. A debarking apparatus as defined in claim 1 wherein a wiper is provided on said apparatus in association with the plunger whereby bark pieces deposited on the upper surface of said plunger member are wiped from the upper surface and into the channel top opening upon withdrawal of the plunger member to its first position.

3. The debarking apparatus as defined in claim 2 wherein the plunger member is provided with a leading upper shearing edge, and a shearing anvil is provided on the apparatus at a position of the channel at the exit end of the debarking station, said shearing anvil and shearing edge cooperating to shear bark pieces protruded from the channel opening as the plunger member is moved to it's second position.

4. A debarking apparatus as defined in claim 3 wherein the apparatus is self-contained and providing with a wheel assembly and pulling attachment to enable the apparatus to be moved from job site to job site.

* * * * *